United States Patent [19]

Shirasaka et al.

[11] 4,384,706

[45] May 24, 1983

[54] METHOD OF PLUGGING UP A TAPHOLE IN A BLAST FURNACE

[75] Inventors: Yoshimi Shirasaka; Minoru Shigeno; Toshinori Minakawa, all of Chiba, Japan

[73] Assignee: Kawasaki Steel Corporation, Kobe, Japan

[21] Appl. No.: 222,167

[22] Filed: Jan. 2, 1981

[30] Foreign Application Priority Data

Jan. 11, 1980 [JP] Japan ..... 55-1362

[51] Int. Cl.[3] ..... C21B 7/12

[52] U.S. Cl. ..... 266/45; 264/30

[58] Field of Search ..... 266/45, 271, 272, 273; 264/30

[56] References Cited

U.S. PATENT DOCUMENTS 4,030,709 6/1977 Shepard et al. ..... 266/45

*Primary Examiner*—M. J. Andrews

*Attorney, Agent, or Firm*—Balogh, Osann, Kramer, Dvorak, Genova & Traub

[57] ABSTRACT

A taphole in a blast furnace is plugged up by charging a mud into the taphole, driving a steel rod into the mud by means of an opener, stopping the driving of the steel rod into the mud when a rear end of the steel rod positions in the middle of the furnace wall and again charging a mud into a cavity behind the rear end of the steel rod embedded in the mud.

3 Claims, 7 Drawing Figures

METHOD OF PLUGGING UP A TAPHOLE IN A BLAST FURNACE

The present invention relates to improvement of a method of plugging up a taphole in a blast furnace.

As prior methods of plugging up a taphole, a method for charging a mud d into a taphole b perforated in a furnace wall a by means of a mud gun as shown in FIG. 1, or a method as shown in FIG. 2 (Japanese Patent No. 818,378), wherein a mud d is charged in the taphole by the method as shown in FIG. 1 and then a steel rod g is driven into the mud by means of an opener f at an original or middle stage of firing of the mud d and maintained in such a state, and the like have been proposed.

However, the former method needs about 4 hours from the plugging up of the taphole to the next tapping and the mud is fired to a high hardness, so that a relatively long time is needed for opening a hole and a time for opening a hole in the hardened mud with strike of a steel rod upon opening is long and cracks are formed in the taphole and therefore the gas in the furnace gets out into the taphole through the formed cracks and the melt is pressed with this gas and scattered, that is splashed over, or the melt is curved and discharged out from the taphole.

In the latter method, the gas in the furnace leaks from a gap between the steel rod g and the mud d and the mud and the refractory material are damaged by the gas and the splashing over of the melt occurs. Furthermore, there is fear that the steel rod g is driven into the mud d and maintained in such a state, so that the steel rod is fused and the melt in the furnace is flowed out.

The present invention is to provide a method of plugging up a taphole in a blast furnace, which obviates these drawbacks and can open the hole in a short time and substantially completely prevent the leakage of the gas and melt in the furnace.

The present invention will be explained in more detail.

For better understanding of the invention, reference is taken to the accompanying drawings, wherein.

Figure 3:
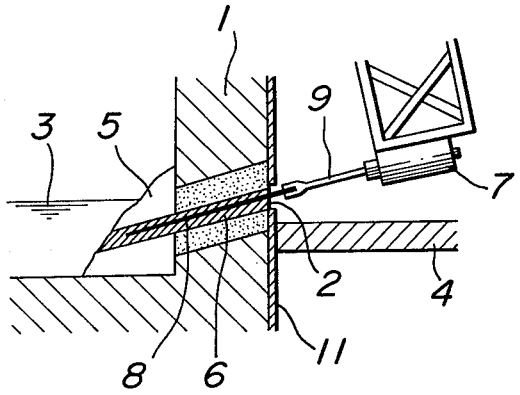
FIGS. 3, 4 and 6 are cross-sectional views of a taphole when the method of the present invention is applied thereto.
Figure 4:
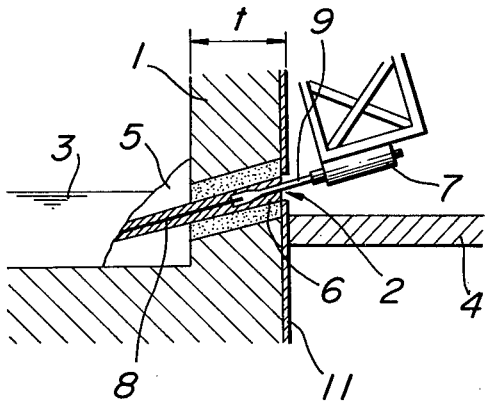

FIGS. 3 and 4 are cross-sectional views showing the embodiment wherein the method of the present invention is applied and a numeral 1 is a furnace wall, a numeral 2 is a taphole perforated in the furnace wall, a numeral 3 is melt in the furnace, a numeral 4 is a trough and a numeral 5 is a flowed in and deposited mud.

Figure 1:
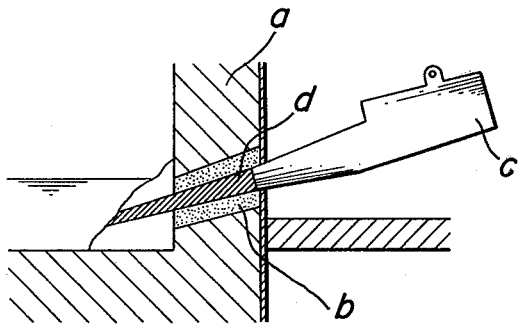
FIG. 1 PRIOR ART
FIGS. 1 and 2 are cross-sectional views showing conventional embodiments.
Figure 2:
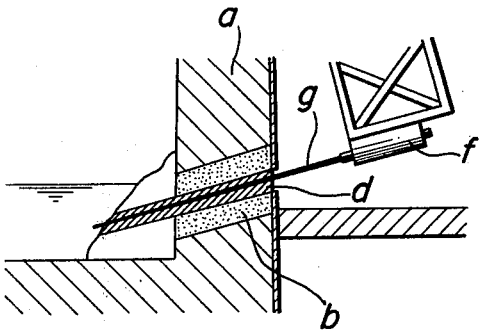
FIG. 2 PRIOR ART
Figure 5A:
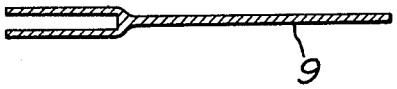
FIG. 5, (*a*) shows a cross-sectional view of a rod holder to be used in the present invention and (*b*) shows a cross-sectional view of a rod holder connected with a steel rod.
Figure 5B:
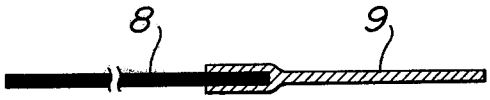

In the present invention, a mud 6 is charged into a taphole 2 as mentioned in FIG. 1, and before the mud 6 is fired, for example, 20–30 minutes after charging the mud, a steel rod 8 is driven into the mud by an opener 7. In this case, the driving of the steel rod into the mud is interrupted at the position where the rear end of the steel rod 8 positions at the outside of the furnace, for example when about 1 m of the steel rod exposes at the outside of the furnace wall and the steel rod 8 is removed from the opener 7, and then a rod holder 9 having a hollow top end portion as shown in FIG. 5, (*a*) is connected with the opener 7 as shown in FIG. 3 and the rear end of the steel rod 8 exposed to the outside of the furnace is held with the rod holder 9 and the steel rod 8 is again driven into the mud 6 together with the rod holder 9 by means of the opener 7, whereby the steel rod 8 is embedded at the given position in the mud 6.

By this embedding, the top end of the steel rod 8 contacts the melt in the furnace and the rear end is positioned in the middle of the furnace wall as shown in FIG. 4. The position of the rear end of the steel rod 8 should be one where after a mud is charged at the subsequent stage, the gas leakage does not occur and the time necessary for opening the hole is relatively short and according to experience, when the thickness of the furnace wall is t, the position is preferred to be $\frac{1}{2}t$–$\frac{2}{3}t$ from the furnace shell surface 11.

Figure 6:
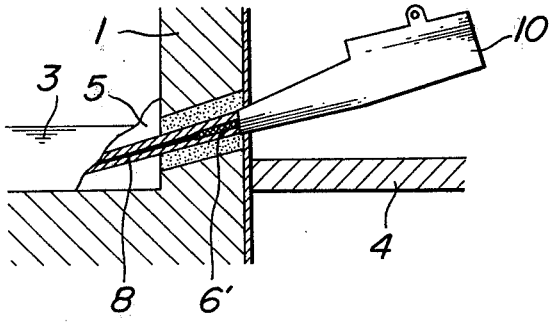

After the steel rod 8 is embedded in the furnace wall, the rod holder 9 is pulled out from the mud 6 and a mud again is charged into the cavity where the rod holder is pulled out, that is backward to the steel rod 8 in the taphole 2 by means of a mud gun 10 as shown in FIG. 6 to completely close the cavity with the mud 6'. After which, the state shown in FIG. 6 is kept for 30–40 minutes to completely fire the charged mud.

By this means, the mud 6 along the zone where the steel rod 8 is inserted, is uniformly fired and can endure the tapping for a long time and the mud charged behind the steel rod 8 completely prevents the leakage of the melt and gas in the furnace. Therefore, the damage of the mud and the refractory material is prevented and the splash-over of the melt does not occur. When the taphole is opened, the mud is dug out by a drill to the rear end of the steel rod 8 and then the steel rod 8 is fused by means of an oxygen pipe, so that the opening of the taphole only needs 3–4 minutes for the drilling of the mud and 2–3 minutes for fusing the steel rod and the necessary time is about $\frac{1}{3}$ of the conventional necessary time which is 20–30 minutes.

In a blast furnace having a furnace wall thickness of 2,100 mm, when the steel rod was driven into the mud 20 minutes after the mud had been charged and the rear end of the steel rod is positioned in the middle of the furnace wall at 1,000 mm from the furnace shell surface and then the mud was again charged therein to close the taphole, no gas leakage was found and the time necessary for opening the hole was about 6 minutes.

Thus, the present invention has the following great practical merits.

(1) It is possible to prevent the leakage of the furnace gas from the taphole and the damage of the mud and the refractory material is prevented and the stable tapping can be carried out.

(2) The unexpected leakage of the melt in the furnace can be prevented and the repair of the trough can be safely conducted.

(3) The time necessary for opening the taphole can be about $\frac{1}{3}$ of the conventional time.

What is claimed is:

1. In a method of plugging up a taphole in a blast furnace in which a mud is charged into the taphole and a steel rod is embedded in the mud before the mud is fired, the improvement comprising projecting a top end of the steel rod into the furnace and positioning a rear end of the steel rod in the middle of the furnace wall and charging again the mud backwardly to the rear end of the steel rod to close the taphole.

2. The method as claimed in claim 1, wherein the steel rod is driven into the mud, the driving of the steel rod into the mud is interrupted when a rear end of the steel rod is positioned at the outside of the furnace wall, the rear end is held with a rod holder which is connected with an opener, the steel rod is again driven into the mud together with the rod holder by means of the opener, the driving of the steel rod held with the rod holder into the mud is stopped at a position where the rear end of the steel rod is positioned in the middle of the furnace wall and then the rod holder is pulled out from the steel rod.

3. The method as claimed in claim 1, wherein the rear end of the steel rod is driven into the mud at positions at $\frac{1}{2}$–$\frac{2}{3}$ of the furnace wall thickness from shell surface of the furnace.

* * * * *